United States Patent [19]

Nilsen

[11] 4,114,345

[45] Sep. 19, 1978

[54] METHOD FOR THE PRODUCTION OF HOUSES

[75] Inventor: Walter Nilsen, Reistad, Norway

[73] Assignee: Den Norske Gipsplatefabrikk A/S, Toerkop p.a. Drammen, Norway

[21] Appl. No.: 785,904

[22] Filed: Apr. 8, 1977

Related U.S. Application Data

[63] Continuation of Ser. No. 541,917, Jan. 17, 1975, abandoned, which is a continuation of Ser. No. 349,597, Apr. 9, 1973, abandoned, which is a continuation of Ser. No. 145,459, May 20, 1971, abandoned.

[30] Foreign Application Priority Data

May 28, 1970 [NO] Norway ..... 2061/70

[51] Int. Cl.[2] ..... E04B 1/12; E04G 21/14

[52] U.S. Cl. ..... 52/745; 264/45.2

[58] Field of Search ..... 52/309.2, 416, 417, 52/745, 220, 309.11; 156/42.43; 264/45.2, 316; 428/520

[56] References Cited

U.S. PATENT DOCUMENTS

| | | | |
|---|---|---|---|
| 1,720,855 | 7/1929 | Payne | 156/42 |
| 2,378,275 | 6/1945 | Williamson | 52/95 |
| 2,893,075 | 7/1959 | Potchen et al. | 52/745 |
| 3,288,896 | 11/1966 | Hendricks | 264/45.2 |
| 3,308,583 | 3/1967 | Chaney | 52/92 |
| 3,394,513 | 7/1968 | Nerem | 52/309.2 |
| 3,440,790 | 4/1969 | Nerem | 52/220 |
| 3,462,897 | 8/1969 | Weinrott | 52/309.11 |
| 3,512,819 | 5/1970 | Morgan et al. | 52/309 |
| 3,652,360 | 3/1972 | Hartman et al. | 428/520 |

FOREIGN PATENT DOCUMENTS

| | | | |
|---|---|---|---|
| 910,156 | 11/1962 | United Kingdom | 52/309 |

*Primary Examiner*—James L. Ridgill, Jr.
*Attorney, Agent, or Firm*—Nolte and Nolte

[57] ABSTRACT

Housing construction by assemblying together extruded wall boards of a width equal to the desired wall height and cut to the appropriate length for each wall. The ceiling structure is then assembled to form a box-like assembly and the doors, windows, etc. are then cut out. The wall panel comprises plastic foam between gypsum boards and is formed with suitable conduits for electrical wire, etc.

3 Claims, 4 Drawing Figures

INVENTOR
WALTER NILSEN
BY Nolte & Nolte
ATTORNEYS

INVENTOR
WALTER NILSEN
BY Nolte & Nolte
ATTORNEYS

METHOD FOR THE PRODUCTION OF HOUSES

This is a continuation of application Ser. No. 541,917, filed Jan. 17, 1975, which is a continuation of Ser. No. 349,597, filed Apr. 9, 1973 which is a continuation of Ser. No. 145,459, filed May 20, 1971, all of which are now abandoned.

BACKGROUND OF THE INVENTION

The invention relates to a method for the production of houses by erecting rectangular wall boards which have the necessary heat insulation and load capacity, e.g. consist of a layer of rigid foamed plastic between two layers of gypsum boards.

Various methods for erecting houses are known, from the assemblage of the separate components on the building site to prefabrication of wall boards and entire units or houses in the factory. All known methods, however, are based on more or less conventional constructional principles.

The object of the present invention is to propose a method which permits a really rapid and simple erection of a house of the above mentioned kind as compared with previously known methods.

BRIEF SUMMARY OF THE INVENTION

According to this invention there is provided a method of producing a house comprising forming a continuous web of a layer of foam plastic thermal insulation sandwiched between layers of gypsum board and in that forming process disposing longitudinally extending channels in said insulation and between said gypsum board layers, said channels being for the reception of conduits and, on a building site providing a plurality of rectangular panels of said web cut to form a first group of panels, securing nailing strips to edges of said panels, assembling said panels, in edge to edge relationship with said channels of continuous channel through said assembly, said panels when so assembled forming the walls of said house without door or window openings and uniting said walls by means of said nailing strips, with the panels of said first group having dimensions corresponding to separate said walls, then supporting a ceiling of a second group of said panels on top of said walls to form a closed box, whereby said closed box comprises a support structure of said house and is formed without framing, and then cutting door and window openings in said panels and in the process of forming said door openings breaching said channels, then grooving edges of said panels defining said door openings from a terminal portion of said channel at one side of the opening to a terminal portion of said channel at the other side of said opening to provide interconnections between said terminal portions of said channel at opposite sides of said door openings and then disposing conductor means within said channels and grooves formed in said edges of said door openings. By extruding the boards in a breadth corresponding to the wall height and cutting them into lengths corresponding to the wall length, then assembling the wall boards to form a closed box preferably comprising all house walls on the building site, and a roof or ceiling is provided and whereafter openings for doors, windows etc. are cut out a very simple process is achieved.

By the aid of wall boards that are extruded and cut into sizes corresponding to the desired walls the house walls can be erected within a few hours and by simple means. When the walls have been erected and the ceiling boards have been provided so that a box-like structure is achieved, door openings can be cut by the aid of a tenon saw or the like, so that it is possible to enter the house to carry out the remaining necessary work. Especially during the cold season it is advantageous to provide a closed, heat insulated structure as fast as possible, so that the remaining work can be carried out in a comfortable indoor climate.

Further necessary openings for windows, inlets etc. can be cut out in a simple manner when needed, for instance when the walls have been provided with sprayed paint, wall paper or the like.

The wall boards can be delivered directly from the factory, extruded in breadths corresponding to the ceiling height and cut into lengths corresponding to the lengths of the walls resp. The production of said wall boards can thus be made automatic and especially rational. The assemblage of the walls can be carried out by the aid of exterior nailing strips at the corners which also may serve as holders for exterior wall panels. The assemblage of the interior walls can be carried out by gluing, by use of adhesive tape or the like, and by the aid of suitable L-irons, T-irons or the like on top of the walls. The walls can be secured to the base of footing or foundation in a manner known per se, suitable nailing strips having been provided at the lower edge of the wall.

Furthermore, nailing strips can be provided in the upper wall edge and in suitable locations, running in the longitudinal direction of the wall, e.g. in the form of plywood ledges, for securing nailing strips for panels etc.

DESCRIPTION OF THE DRAWINGS

Further objects and features of the present invention will appear from the following description of an embodiment shown as an example in the drawing, where.

DESCRIPTION OF THE PREFERRED EMBODIMENTS OF THE INVENTION

Figure 1:
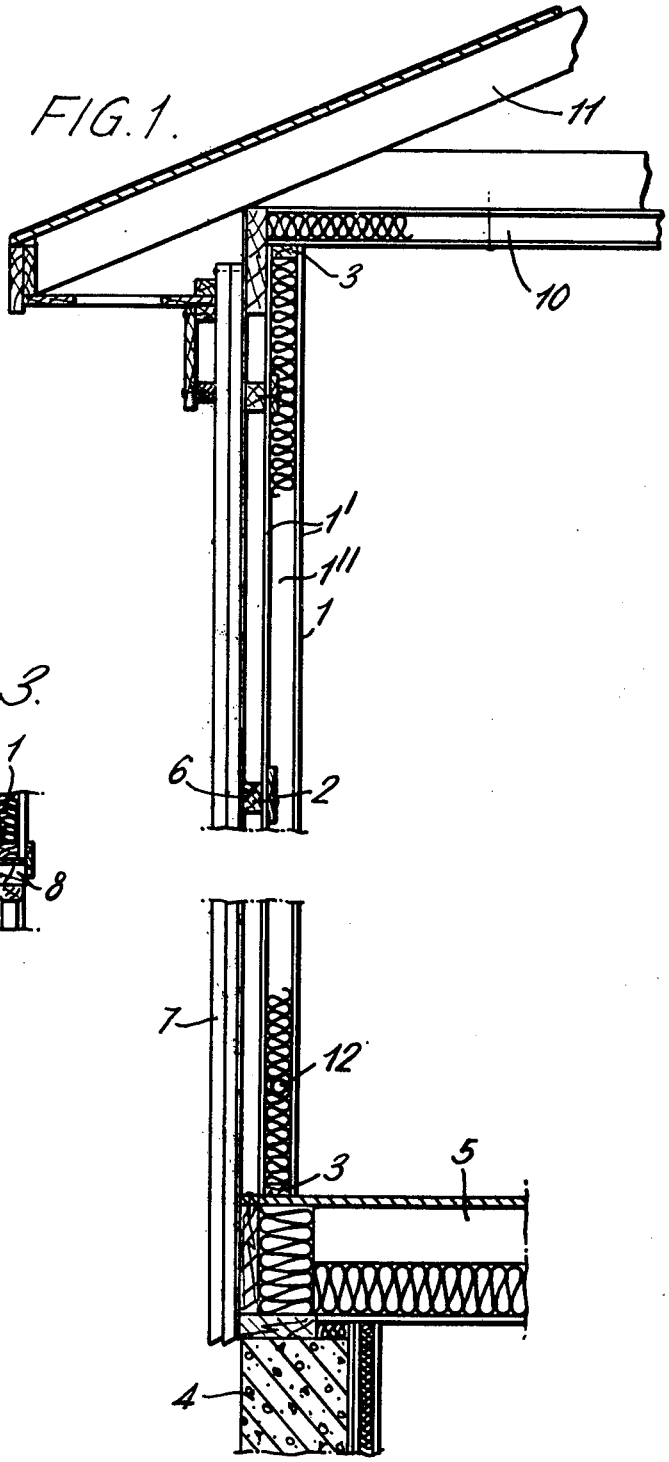
FIG. 1 shows a section through a house constructed according to the invention.

In FIG. 1 a wall board 1 according to a prefered embodiment comprises two gypsum boards 1' with intermediary foamed polyurethane plastic 1''. Said board is for instance, extruded in a breadth of e.g. 2.40 m, corresponding to the length of the wall in question. Within the gypsum board nailing strips 2, e.g. of plywood, are provided in the longitudinal direction of the wall board as well as nailing strips 3 extending throughout the wall board thickness between the gypsum boards and provided at the top edge and the base of the wall board.

On a footing or foundation wall 4 a floor 5 of a known kind is provided. The wall boards or first group of panels are nailed to said floor, if desired, with caulk provided between the wall boards and the floor. on the exterior walls there are nailing strips 6 for the attachment of panels 7 known per se. On top of the wall boards, ceiling boards 10 of a second group of panels preferably of the same structure as said wall boards are arranged. Roof trusses 11 of a type known per se rest on the ceiling boards.

Figure 3:
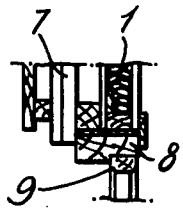
FIG. 3 is a section through a wall having a framed window inserted
Figure 2:
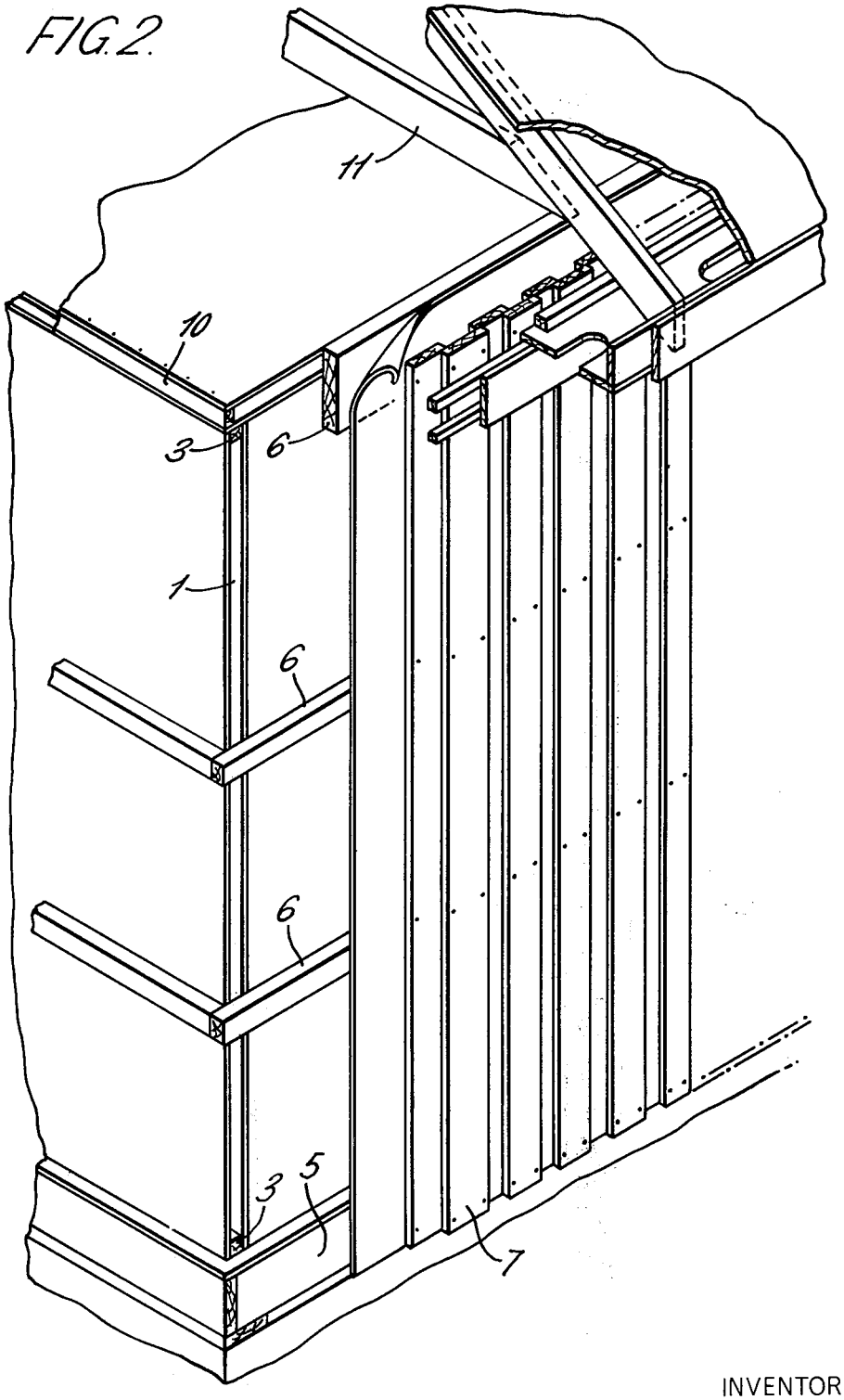
FIG. 2 shows a perspective of the corner joint of the house according to FIG. 1, where certain construction members have been entirely or partly removed to show various details.

FIG. 3 shows how a window having a window frame 8 and a casement 9 can be mounted.

Figure 4:
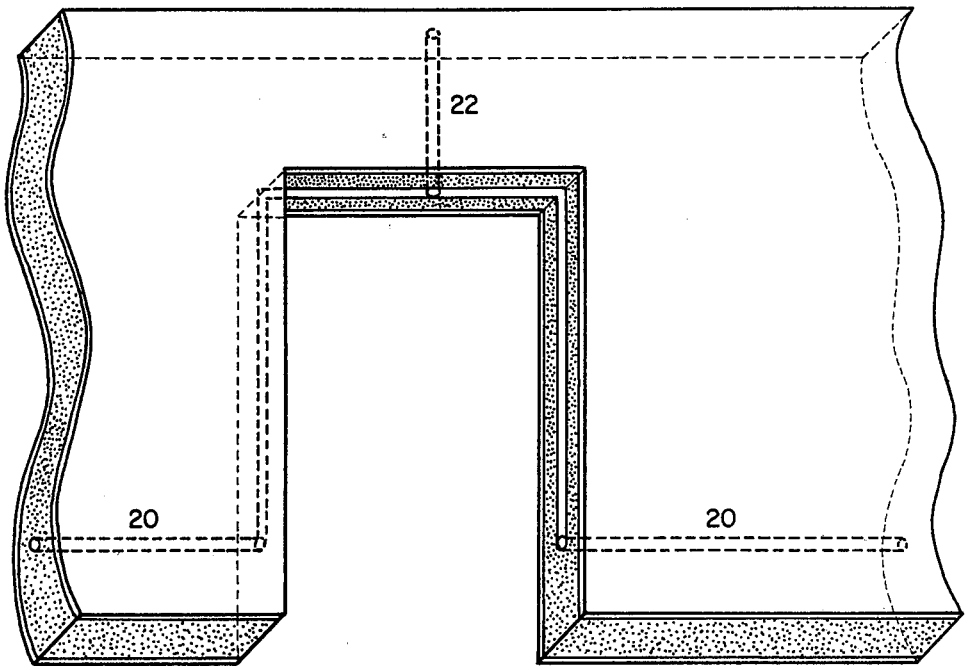
FIG. 4 is a perspective view of a portion of a wall board illustrating the grooving of the door opening to serve as an electrical conduit.

At a certain distance from the base of the wall board, e.g. 25–30 cm, a continuous channel 20 for concealed electric conduits may extend in the longitudinal direction of the wall boards as shown in FIG. 4. When the house has been erected and the walls have been given a finishing treatment, recesses for connector boxes etc. can be made flush with said channel. To provide a connection between a wall and an adjacent transversal wall a suitable opening is made into the channel flush with the channel opening of the adjacent wall before said walls are erected.

In door openings which necessarily break the channel connections a groove 21 is made in the edge of the said opening to form a connection between a terminal portion of said channel at one side of the opening and a terminal portion of the channel at the opposite side of the opening and the conduits are extended around the door opening and into the channel on the other side. To form connections between said channels in wall boards and ceiling boards a channel 22 is made from said groove in the door opening through the wall board and into the ceiling board to a channel in said ceiling board. Connector boxes are installed in ceiling boards in the same manner as in the wall boards.

According to a preferred embodiment said channel is produced by inserting a plastic stocking 12 during the extrusion of the wall boards. A most desirable technique for producing the panels is that described in applicant's U.S. Pat. No. 3,917,775, but it is to be appreciated that other and known techniques for the production of such panels may be adopted.

I claim:

1. A method of producing a house comprising forming a continuous web of a layer of foam plastic thermal insulation sandwiched between layers of gypsum board and in that forming process disposing longitudinally extending channels in said insulation and between said gypsum board layers, said channels being for the reception of conduits and, on a building site providing a plurality of rectangular panels of said web cut to form a first group of panels, securing nailing strips to edges of said panels, assembling said panels, in edge to edge relationship with said channels of adjacent panels registering with one another to form a continuous channel through said assembly, said panels when so assembled forming the walls of said house without door or window openings and uniting said walls by means of said nailing strips, with the panels of said first group having dimensions corresponding to separate said walls, then supporting a ceiling of a second group of said panels on top of said walls to form a closed box, whereby said closed box comprises a support structure of said house and is formed without framing, and then cutting door and window openings in said panels and in the process of forming said door openings breaching said channels, then grooving edges of said panels defining said door openings from a terminal portion of said channel at one side of the opening to a terminal portion of said channel at the other side of said opening to provide interconnections between said terminal portions of said channel at opposite sides of said door openings and then disposing conductor means within said channels and grooves formed in said edges of said door openings.

2. The method of claim 1 further comprising securing exterior walls on panels of said first group after the formation of said closed box.

3. The method of claim 1 further comprising securing roof trusses onto said ceiling after the formation of said closed box.

* * * * *